US005437365A

United States Patent [19]

Solheim

[11] Patent Number: 5,437,365

[45] Date of Patent: Aug. 1, 1995

[54] GOLF BAG WITH AUXILIARY HANDLES

[75] Inventor: John A. Solheim, Phoenix, Ariz.

[73] Assignee: Karsten Manufacturing Corporation, Phoenix, Ariz.

[21] Appl. No.: 383,659

[22] Filed: Feb. 2, 1995

Related U.S. Application Data

[63] Continuation of Ser. No. 189,721, Jan. 27, 1994, abandoned.

[51] Int. Cl.[6] ..... A63B 55/00

[52] U.S. Cl. ..... 206/315.3; 206/315.8; 224/204

[58] Field of Search ..... 206/315.3, 315.8, 315.4, 206/315.5; 224/202, 205, 257, 258, 209, 204, 259

[56] References Cited

U.S. PATENT DOCUMENTS

| | | | |
|---|---|---|---|
| D. 348,567 | 7/1994 | Dunn | D3/255 |
| 1,203,095 | 10/1916 | Bristow | 206/315.3 X |
| 2,006,920 | 7/1935 | Hotze | 206/315.8 X |
| 2,034,394 | 3/1936 | Hotze | 206/315.8 X |
| 2,732,872 | 1/1956 | Hurdle et al. | 224/205 |
| 2,861,614 | 11/1958 | Kish, Jr. | 206/315.8 X |
| 3,799,227 | 3/1974 | Contwell | 206/315.3 X |
| 4,746,159 | 5/1988 | Webb et al. | 224/917 X |
| 5,042,654 | 8/1991 | Jones | 206/315.3 |
| 5,042,704 | 8/1991 | Izzo | 206/315.3 X |
| 5,348,205 | 9/1994 | Steurer | 224/214 X |

FOREIGN PATENT DOCUMENTS

| | | | |
|---|---|---|---|
| 780347 | 7/1957 | United Kingdom | 206/315.3 |

*Primary Examiner*—Allan N. Shoap
*Assistant Examiner*—Christopher J. McDonald
*Attorney, Agent, or Firm*—Darrell F. Marquette; Herbert E. Haynes, Jr.

[57] ABSTRACT

A golf bag has a generally tubular body with an open top end and a closed bottom end. A shoulder strap has an upper end connected to the body adjacent the top end thereof and a lower end connected to the body intermediate the top and bottom ends thereof. The shoulder strap is long enough to loop over one shoulder of a person. A pair of auxiliary handles are attached to the body adjacent the bottom end. Each auxiliary handle is disposed so that it may be grasped by one hand of the person carrying the golf bag when utilizing the shoulder strap.

5 Claims, 2 Drawing Sheets

GOLF BAG WITH AUXILIARY HANDLES

This is a continuation of application Ser. No. 08/189,721 filed Jan. 27, 1994 abandoned.

BACKGROUND OF THE INVENTION

This invention relates generally to bags for carrying golf clubs and, in particular, to a golf bag having auxiliary handles.

Golf bags typically have a generally tubular body with a top end which is open and a bottom end which is closed. A shoulder strap has an upper end attached to the body near the top end and a lower end attached to the body intermediate the top and bottom ends thereof. Golf clubs are inserted and removed from the golf bag through the open top end. A handle is usually mounted on the bag between the upper and lower ends of the shoulder strap. The golf bag may be carried by utilizing either the shoulder strap or the handle. When carried by the shoulder strap, the golf bag may cause fatigue and shoulder soreness since it will contain golf clubs and accessories that are relatively heavy.

U.S. Pat. No. 2,853,111 to Anna K. Williams discloses a golf bag that prevents undue fatigue and shoulder soreness. The golf bag includes two shoulder straps for looping over both of a person's shoulders thereby allowing the golf bag to be carried in a manner similar to a backpack. A drawback of the Williams golf bag is that it is difficult to remove and insert golf clubs because the golf bag is disposed across the person's back while being carried by the shoulder straps.

U.S. Pat. No. 5,042,654 to George H. Jones discloses a golf bag designed to facilitate lifting of the bag into or out of an automobile trunk. The golf bag includes a shoulder strap and a hand hold formed in its bottom end which is used in conjunction with a handle mounted along one side of the bag to lift the bag and move it in a horizontal orientation. A drawback of the Jones golf bag is that it would be difficult to use the hand hold in conjunction with the shoulder strap while carrying the bag.

U.S. Pat. No. 5,038,984 to Theodore J. Izzo discloses a dual strap carrying system for golf bags. This strap system includes two shoulder strap members extending longitudinally of the bag. The strap members are utilized to allow a person to carry the golf bag on both shoulders. A drawback of the Izzo dual strap carrying system is that it is bulky.

SUMMARY OF THE INVENTION

The present invention provides a golf bag comprising a generally tubular body having a spine, a top end which is open and a bottom end which is closed. The spine extends longitudinally of the body between the top and bottom ends thereof. The golf bag includes a shoulder strap having an upper end attached to the body adjacent the top end thereof and a lower end attached to the body intermediate the upper and lower ends thereof. The shoulder strap is of sufficient length for looping over one shoulder of the person. A pair of auxiliary handles are attached to the body adjacent the bottom end thereof. Each of the pair of auxiliary handles is disposed so that it may be grasped by one hand of the person carrying the golf bag when utilizing the shoulder strap.

In the preferred embodiment, each of the pair of auxiliary handles extends diagonally relative to the spine of the body and in substantially opposite directions from the spine. Each auxiliary handle has a first end attached to the body along the spine and a second end attached to the body at a location spaced circumferentially from the spine. The auxiliary handles are twisted intermediate their first and second ends.

DESCRIPTION OF THE PREFERRED EMBODIMENT

Figure 1:
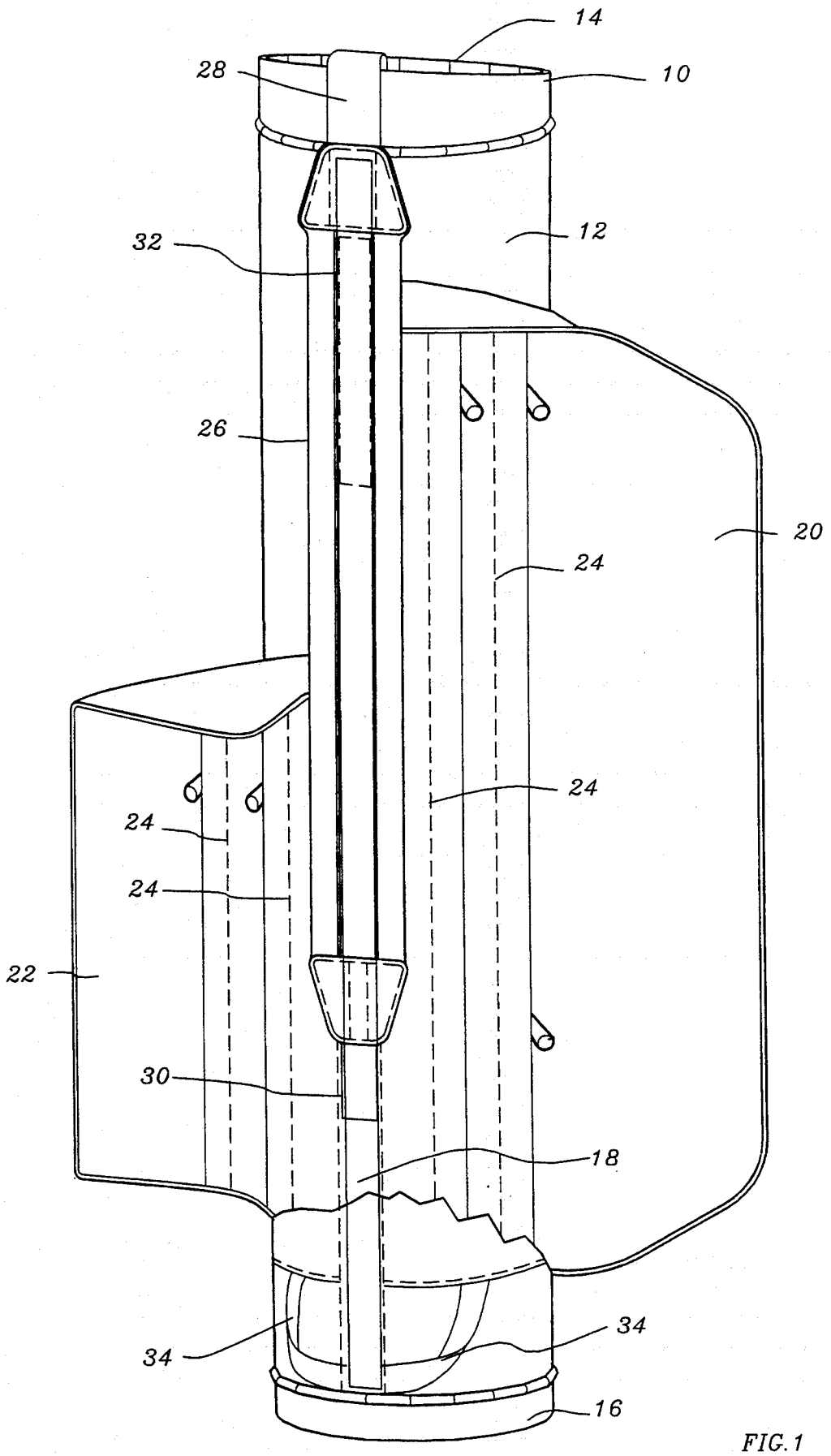
FIG. 1 is a side elevation view of a golf bag embodying the preferred/embodiment of the present invention.

Referring to FIG. 1, a golf bag 10 has a generally tubular body 12 with a top end 14 which is open and a bottom end 16 which is closed. Golf clubs may be inserted and removed through the top end 14 of the body 12 in conventional manner. The body 12 includes a spine 18 that extends longitudinally between the top and bottom ends 14, 16. The golf bag 10 also has a large storage pocket 20 attached along one side of the body 12 and a small storage pocket 22 attached along another side of the body 12. Zippers 24 provide access to the storage pockets 20, 22.

Preferably, the top and bottom ends 14, 16 of the body 12 are formed of rigid material such as molded plastic while the remainder of the body 12 and the storage pockets 20, 22 are formed of a flexible material such as nylon. The top end 16 of the body 12 may include a throat structure as disclosed in U.S. Pat. No. 4,596,328 to John A. Solheim.

A shoulder strap 26 has an upper end 28 connected to the body 12 near the top end 14 thereof and a lower end 30 connected to the body 12 intermediate the top and bottom ends 16 thereof. The shoulder strap 26 is long enough to permit it to be looped over a person's shoulder. The shoulder strap 26 may be utilized in conventional manner by a person to carry the golf bag 10 on either shoulder. The golf bag 10 also has a handle 32 mounted on the body 12 along the spine 18 between the upper and lower ends 28, 30 of the shoulder strap 26. The handle 32 may be used, in lieu of the shoulder strap 26, to carry the golf bag 10 by either hand.

Figure 2:
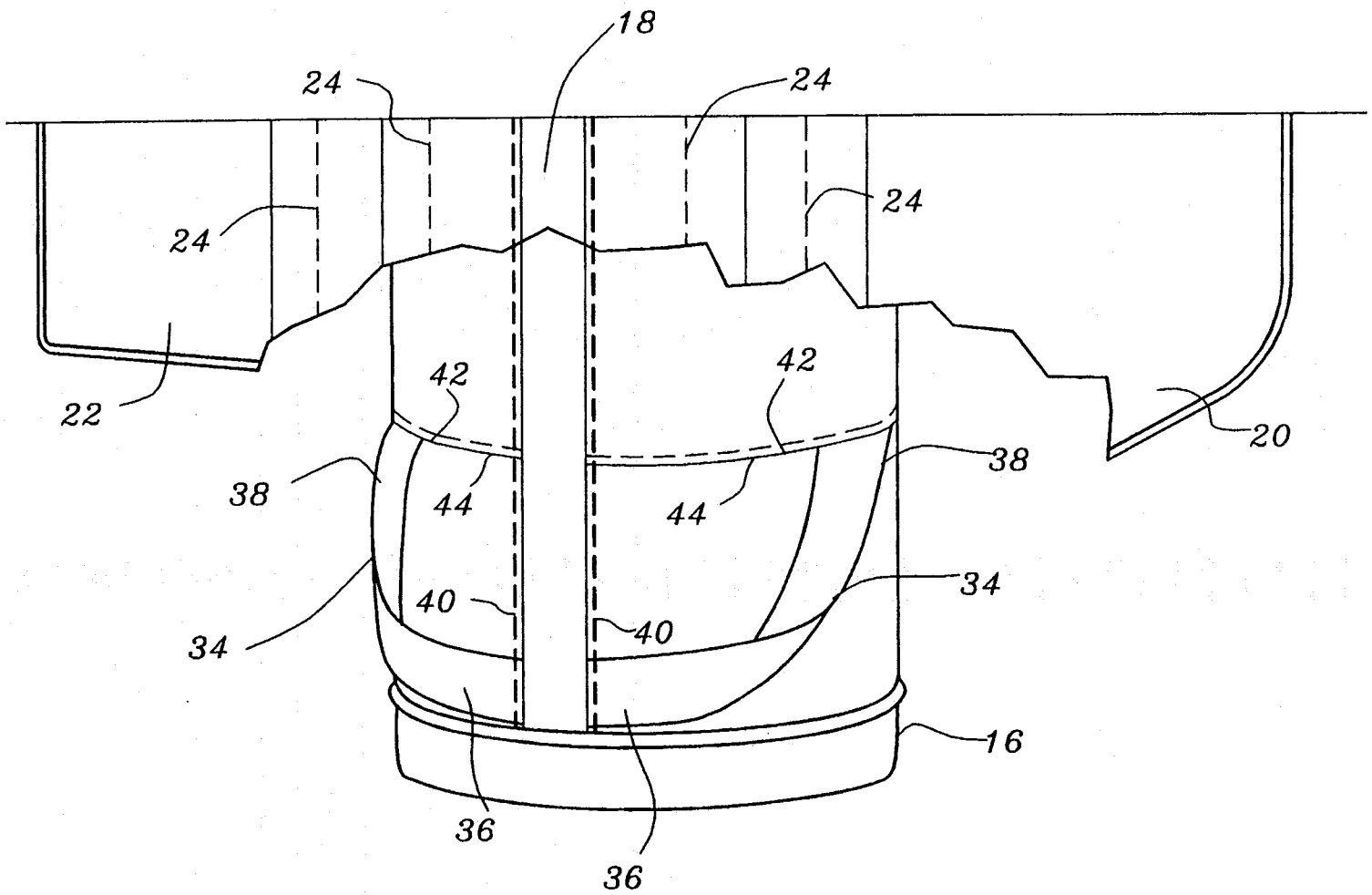
FIG. 2 is an enlarged view of a lower portion of the golf bag shown in FIG. 1.

According to the present invention, a pair of auxiliary handles 34 are provided near the bottom end 16 of the body 12. As shown in FIG. 2, each handle 34 has a first end 36 secured by stitching 40 along the spine 18, and a second end 38 secured by stitching 42 at a circumferential seam 44. The ends 38 of the handles 34 are secured to the body 12 at locations spaced circumferentially from the spine 18. The handles 34 extend diagonally relative to the spine 18 and in substantially opposite directions from the spine 18. Each handle 34 is twisted intermediate its first and second ends 36, 38. Such twisting of the handles 34 prevents them from lying flat against the body 12 and thus makes it easier to grasp them. Preferably, each handle 34 is formed as a strip of flexible material that is approximately seven inches long and one inch wide.

When a person desires to carry the golf bag 10 by utilizing the shoulder strap 26, the shoulder strap 26 is looped over either shoulder. Then, the person reaches backward with the opposite hand and grasps one of the handles 34. For example, if the shoulder strap 26 is looped over the left shoulder, then the right hand would be used to grasp one of the handles 34. Conversely, if the shoulder strap 26 is looped over the right shoulder, then the left hand would be used to grasp one of the handles 34.

By using the handles 34 in conjunction with the shoulder strap 26 when carrying the golf bag 10, a person will reduce fatigue and shoulder soreness while being able to insert and remove golf clubs through the top end 14 of the body 12.

What is claimed is:

1. A golf bag adapted to be carried by a person, said golf bag comprising:

a generally tubular body having a spine, a top end which is open and a bottom end which is closed, said spine extending longitudinally of said body between said top and bottom ends;

a first storage pocket attached to said body along one side thereof;

a second storage pocket attached to said body along another side thereof;

a shoulder strap having an upper end connected to said body adjacent said top end thereof and a lower end connected to said body intermediate said upper and lower ends thereof, said shoulder strap being of sufficient length for looping over one shoulder of the person;

a pair of auxiliary handles attached to said body adjacent said bottom end thereof, each of said pair of auxiliary handles being disposed so that it may be grasped by one hand of the person carrying the golf bag when utilizing said shoulder strap, one of said pair of auxiliary handles being disposed below said first storage pocket, and the other one of said pair of auxiliary handles being disposed below said second storage pocket; and each of said pair of auxiliary handles having a first end attached to said body adjacent said spine at a first location proximate said closed end thereof and a second end attached to said body at a second location spaced circumferentially away from said spine, said second location being disposed intermediate said first location and said top end of said body when viewed in a longitudinal direction extending from said bottom end of said body toward said top end thereof.

2. The golf bag of claim 1, wherein each of said pair of auxiliary handles extends diagonally relative to said spine of said body.

3. The golf bag of claim 2, wherein said pair of auxiliary handles extend in substantially opposite directions from said spine.

4. The golf bag of claim 3, wherein each of said pair of auxiliary handles are twisted intermediate said first and second ends thereof.

5. The golf bag of claim 4, wherein each of said pair of auxiliary handles are formed as a strip of flexible material.

* * * * *